US007607702B2

(12) United States Patent
Pereverzev

(10) Patent No.: US 7,607,702 B2
(45) Date of Patent: Oct. 27, 2009

(54) INERTIA CATCH FOR A VEHICLE LATCH

(75) Inventor: Igor Pereverzev, Farmington Hills, MI (US)

(73) Assignee: Intier Automotive Closures Inc., Newmarket, Ontario (CA)

( * ) Notice: Subject to any disclaimer, the term of this patent is extended or adjusted under 35 U.S.C. 154(b) by 279 days.

(21) Appl. No.: 10/522,507

(22) PCT Filed: Jul. 25, 2003

(86) PCT No.: PCT/CA03/01167

§ 371 (c)(1),
(2), (4) Date: Jan. 17, 2006

(87) PCT Pub. No.: WO2004/011749

PCT Pub. Date: Feb. 5, 2004

(65) Prior Publication Data

US 2006/0131892 A1 Jun. 22, 2006

(51) Int. Cl.
*E05C 3/06* (2006.01)

(52) U.S. Cl. ..... 292/216; 292/201; 292/DIG. 23

(58) Field of Classification Search ..... 292/216, 292/201, DIG. 23

See application file for complete search history.

(56) References Cited

U.S. PATENT DOCUMENTS

| | | | | |
|---|---|---|---|---|
| 2,864,641 | A | 12/1958 | Leslie | |
| 3,104,124 | A | 9/1963 | Beck | |
| 3,453,015 | A | 7/1969 | Miller | |
| 3,583,741 | A | 6/1971 | Breitschwerdt et al. | |
| 3,799,596 | A | 3/1974 | Nozomu et al. | |
| 4,382,622 | A | 5/1983 | Ishikawa | |
| 4,422,522 | A | 12/1983 | Slavin et al. | |
| 5,308,130 | A * | 5/1994 | Lee | 292/336.3 |
| 5,431,462 | A | 7/1995 | Lignell | |
| 5,577,782 | A | 11/1996 | Johnson et al. | |
| 5,584,516 | A | 12/1996 | Cetnar | |
| 5,865,481 | A * | 2/1999 | Buschmann | 292/216 |
| 5,899,508 | A * | 5/1999 | Cetnar et al. | 292/216 |
| 6,010,164 | A | 1/2000 | Yoda | |

(Continued)

FOREIGN PATENT DOCUMENTS

| | | | |
|---|---|---|---|
| DE | 1678024 | * | 8/1971 |

(Continued)

*Primary Examiner*—Carlos Lugo
*Assistant Examiner*—Kristina R Fulton
(74) *Attorney, Agent, or Firm*—Clark Hill PLC

(57) ABSTRACT

A latch mechanism for selectively latching a door to an automotive vehicle. The latch mechanism includes a latch hook movable between locked and unlocked positions relative to a striker bar fixedly secured to the vehicle. A release lever is operatively coupled between the latch hook and the latch mechanism for selectively actuating the latch hook between the locked and unlocked positions. An inertia lever is engagable with the release lever to prevent movement of the latch hook between the unlocked and locked positions. The inertia lever is movably coupled to the latch mechanism for movement in and out of engagement with the release lever in response to a threshold acceleration of the vehicle. A slot is formed in the release lever presenting sides engagable with the inertia lever to automatically rock the inertia lever in response to movement of the release lever to prevent seizing of the inertia lever within the latch mechanism due to lack of use.

8 Claims, 3 Drawing Sheets

U.S. PATENT DOCUMENTS

| | | | | |
|---|---|---|---|---|
| 6,106,033 | A | 8/2000 | Ruckert | |
| 6,328,353 | B1 | 12/2001 | Barczynski et al. | |
| 2001/0015558 | A1 | 8/2001 | Fisher et al. | |
| 2006/0103138 | A1 * | 5/2006 | Drysdale et al. | 292/1 |
| 2006/0261602 | A1 * | 11/2006 | Jankowski et al. | 292/216 |
| 2006/0261603 | A1 * | 11/2006 | Cetnar et al. | 292/216 |

FOREIGN PATENT DOCUMENTS

| | | |
|---|---|---|
| DE | 195 11 651 | 10/1995 |
| DE | 197 38 492 | 3/1998 |

* cited by examiner

INERTIA CATCH FOR A VEHICLE LATCH

BACKGROUND OF THE INVENTION

1. Field of the Invention

The invention relates to a latch for selectively locking a door of an automotive vehicle, and more particularly, a lateral inertia lever for preventing the release of the latch in the event of a lateral vehicle impact.

2. Description of the Prior Art

Automotive vehicles include hinged doors for allowing and closing access to passenger or cargo compartments within the vehicle. Typically, a latch mechanism is coupled between the door and the vehicle for releasably locking the door in a closed position with the vehicle. A release mechanism is typically coupled to the latch mechanism for selectively locking and unlocking the latch mechanism. It remains desirable to provide a mechanism for preventing the latch mechanism from unlocking during a side impact upon the vehicle.

SUMMARY OF THE INVENTION

According to one aspect of the invention, a latch mechanism is provided for selectively latching a door to an automotive vehicle. The latch mechanism includes a latch hook movable between locked and unlocked positions. A release lever is operatively coupled to the latch hook for selectively moving the latch hook between the locked and unlocked positions. The latch mechanism includes an inertia lever engagable with the release lever to prevent movement of the latch hook between the locked and unlocked positions. The inertia lever is movably supported within the latch mechanism for moving in and out of engagement with the release lever in response to a side impact upon the vehicle.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
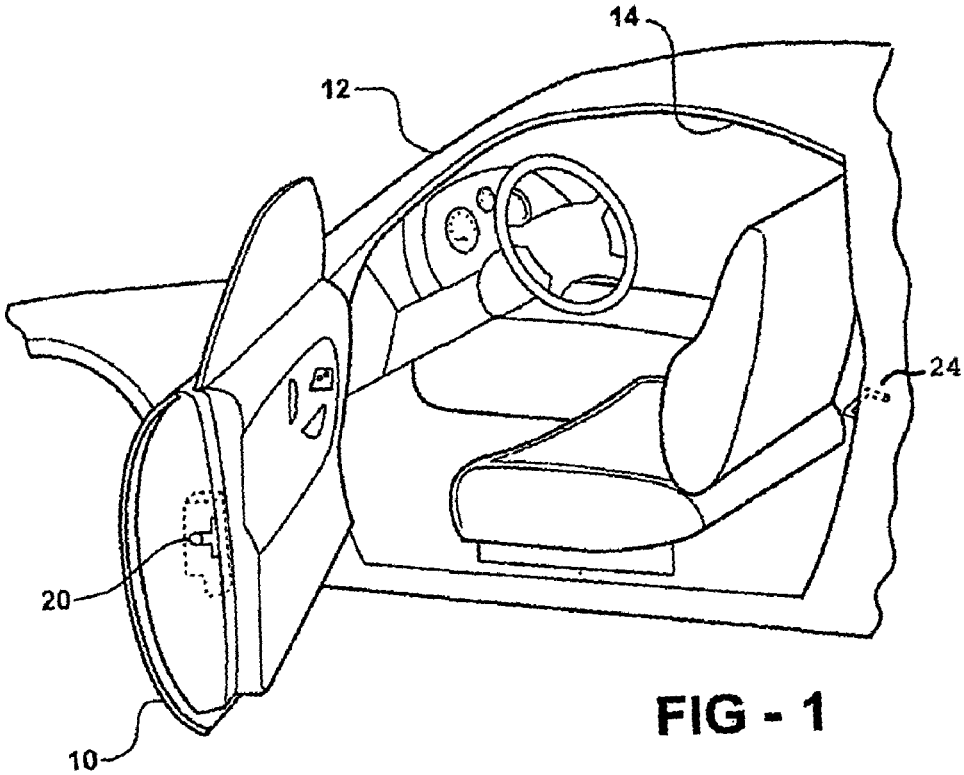
FIG. 1 is a partial perspective view of an automotive vehicle incorporating a latch mechanism according to one embodiment of the invention.

Referring to the figures, FIG. 1 illustrates a door 10 for an automotive vehicle 12 incorporating a latch 20 mechanism according to one embodiment of the invention. The door 10 is hinged to the vehicle 12 for pivotal movement between a closed position nested within an opening 14 in the vehicle and an opened position to allow access into the vehicle 12 through the opening 14. The latch mechanism 20 is fixedly mounted to the door 10 for releasably locking the door 10 in the closed position.

Figure 2A:
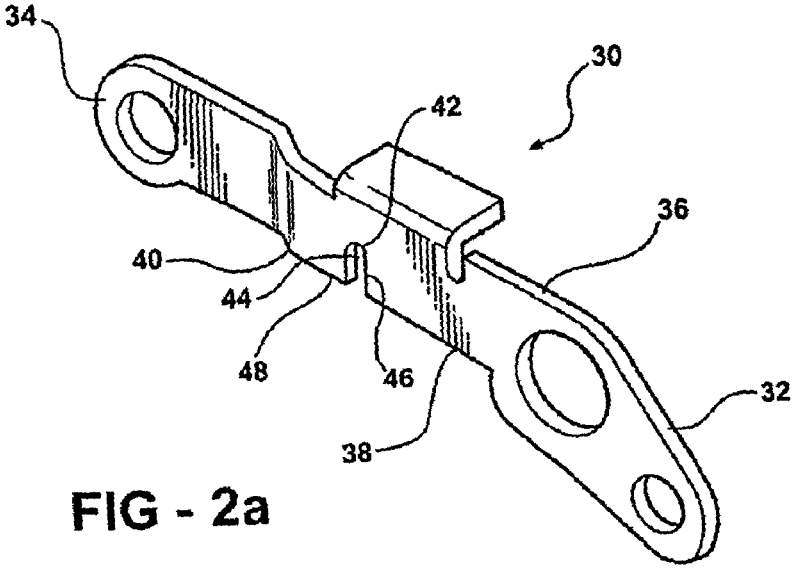
FIG. 2*a* is a perspective view of a release lever in the latch mechanism.
Figure 2:
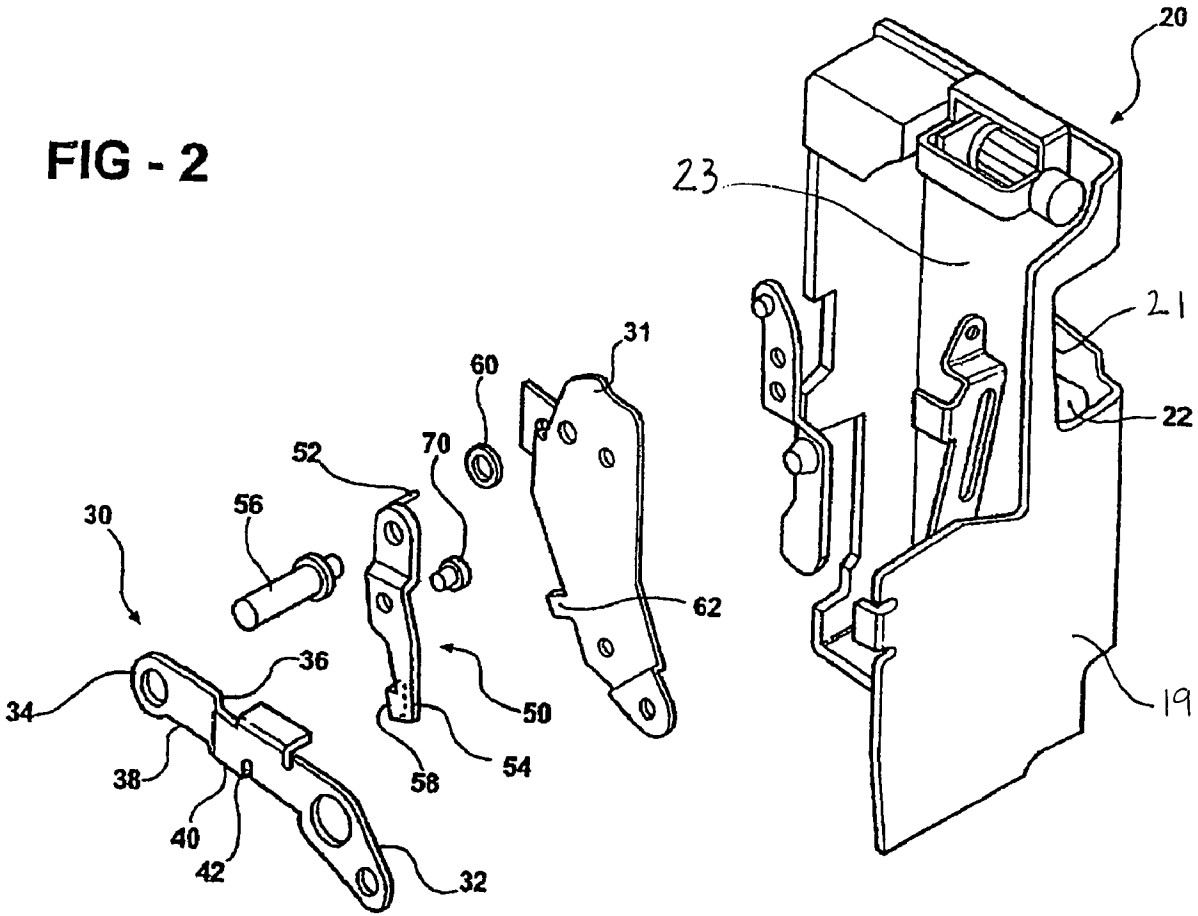
FIG. 2 is a partially exploded perspective view of the latch mechanism.
Figure 3:
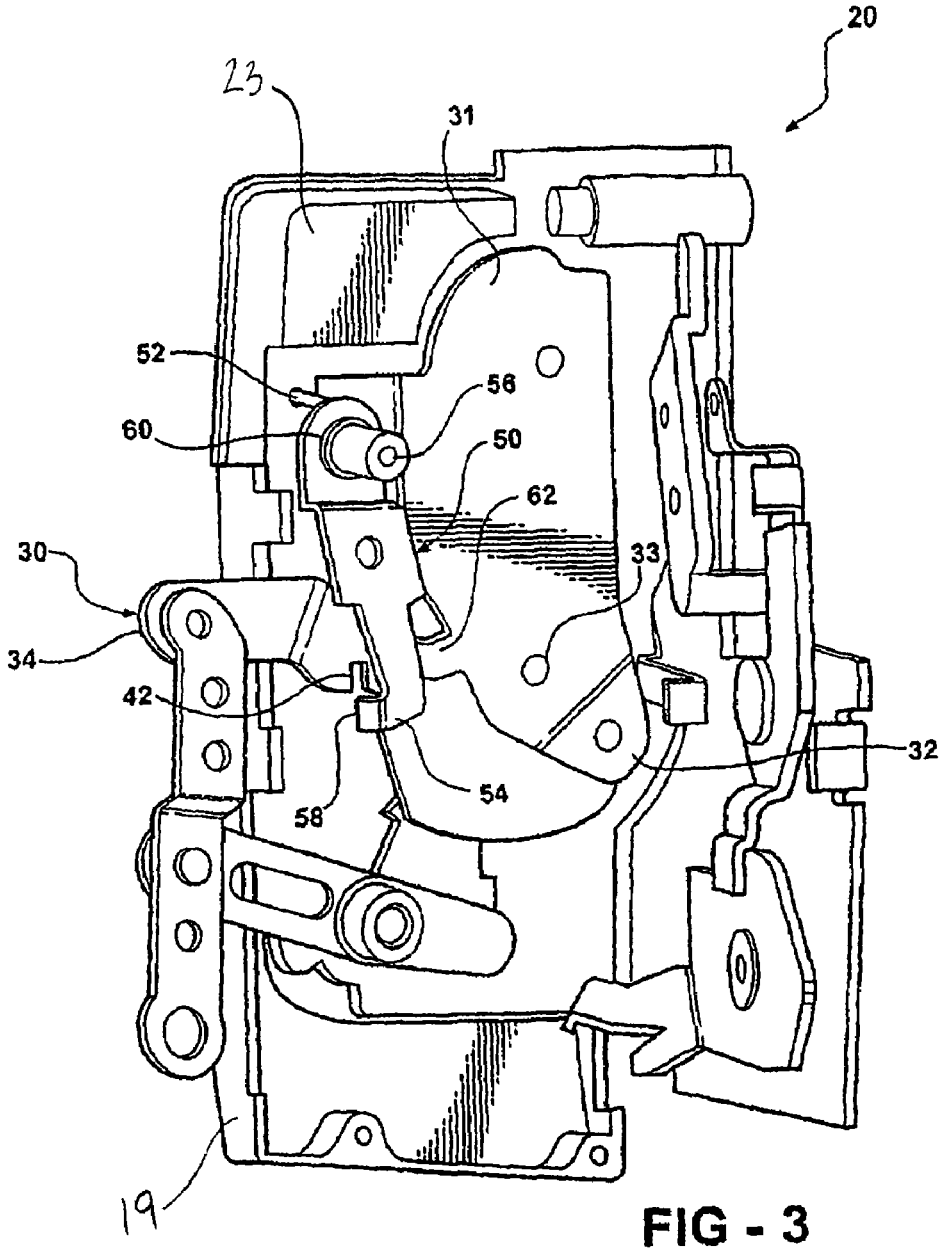
FIG. 3 is a perspective view of the latch mechanism.

Referring to FIGS. 1-3, the latch mechanism 20 includes a housing 19 having a first side 21 and an opposite second side 23. A latch hook 22 is disposed on the first side 21 of the housing 19 and is lockably engagable with a striker bar 24 fixedly secured to the vehicle 12. The latch hook 22 is movable between a locked position lockingly engaged with the striker bar 24 and an unlocked position disengaged with the striker bar 24 to allow movement of the door 12 between the closed and opened positions. The latch hook 22 is biased toward the locked position by a biasing member (not shown) of any suitable variety, such as a clock spring extending between the latch mechanism 20 and the latch hook 22. A release lever 30 is pivotally mounted to a mounting bracket 31 that is disposed on the second side 23 of the housing 19 and is operatively coupled to the latch hook 22 for moving the latch hook 22 between the locked and unlocked positions in response to clockwise and counterclockwise movement of the release lever 30, as viewed in FIGS. 2 and 3. A detailed description of the structure and function of such a latch mechanism 20 is disclosed in commonly owned U.S. Pat. No. 6,328,353 B1 issued on Dec. 11, 2001, which is incorporated herein by reference in its entirety.

The release lever 30 includes a proximal end 32 pivotally coupled to the mounting bracket 31 by a pivot pin 33 and an opposite distal end 34 extending outwardly from the latch mechanism 20. The release lever 30 includes opposite upper and lower edges 36, 38 extending longitudinally between the proximal and distal ends 32, 34. A raised abutment surface 40 is formed along a portion of the lower edge 38 adjacent the distal end 34. A relief slot 42 is cut or formed in the lower edge 38 between the proximal end 32 and the abutment surface 40. The slot 42 extends between opposing first and second sides 44, 46. The first side 44 of the slot 42 and the lower edge 38 intersect to present a generally raised abutment tip 48.

The latch mechanism 20 includes an inertia lever 50 extending between opposite proximal and distal ends 52, 54. The distal end 54 is defined by a bent tab 58 engagable with either the abutment surface 40 or the slot 42 in the release lever 30. The proximal end 52 of the inertia lever 50 is pivotally coupled to the mounting bracket 31 by a pivot pin 56 for moving the tab 58 between engagement with the abutment surface 40 or the slot 42. A biasing member 60 extends between the inertia lever 50 and the housing 19 for biasing the inertia lever 50 in a counterclockwise direction, as viewed in the figures, towards engagement with a stop 62 formed in the mounting bracket 31. With the inertia lever 50 abutting the stop 62, the tab 58 is presented for moving in and out of the slot 42 to allow counterclockwise and clockwise movement of the release lever 30 about the pivot pin 33 for actuating the latch hook 22 between the unlocked and locked positions, respectively. The first side 44 of the slot 42 and the tip 48 engage the tab 58 to lightly toggle the inertia lever 50 in and out of contact with the stop 62 during clockwise and counterclockwise rotation of the release lever 30.

A weight 70 is fixedly secured to the inertia lever 50 between the proximal and distal ends 52, 54 by any suitable means, such as welding or bolting. The weight 70 has a predetermined mass and is secured to the inertia lever 50 at a predetermined distance from the pivot pin 56 to cause clockwise rotation of the inertia lever 50 against the bias of the biasing member 60 beyond a threshold lateral acceleration of the vehicle generally associated with a side impact upon the vehicle.

In operation, under normal vehicle operating conditions, the release lever 30 is rotated counterclockwise and clockwise for actuating the latch hook 22 between the unlocked and locked positions, respectively. The biasing member 60 continuously biases the inertia lever 50 against the stop 62. As a result of this bias, the release lever 30 is permitted to rotate counterclockwise to unlock the latch hook 22 because the slot 42 is generally aligned with the tab 58 enabling the tab 58 to enter the slot 42. In addition, the arcuate movement of the release lever 30, causes the first side 44 of slot 42 and the tip 48 to engage the tab 58 to rock the inertia lever 50 in and slightly out of contact with the stop 62 during clockwise and counterclockwise rotation of the release lever 30 to prevent the inertia lever 50 from binding on the pivot pin 56.

In the event of a side impact of the vehicle 12 or similar sudden acceleration, the weight 70 applies a torque moment upon the inertia lever 50 to cause the inertia lever 50 to rotate clockwise so that the tab 58 is presented for engaging the abutment surface 40. Should the release lever 30 rotate counterclockwise, the abutment surface 40 will engage the tab 58. While engaged with the abutment surface 40, the tab 58 prevents actuation of the latch hook 22 to the unlocked position by preventing counterclockwise movement of the release lever 30.

The invention has been described in an illustrative manner, and it is to be understood that the terminology, which has been used, is intended to be in the nature of words of description rather than of limitation.

Many modifications and variations of the present invention are possible in light of the above teachings. It is, therefore, to be understood that within the scope of the appended claims, the invention may be practiced other than as specifically described.

What is claimed is:

1. A latch mechanism for selectively latching a door to an automotive vehicle, said latch mechanism comprising:

a latch hook movable between a locked position and an unlocked position;

a release lever operatively coupled to said latch hook for selectively moving said latch hook from said locked to said unlocked position; and an inertia lever movably supported within said latch mechanism and biased to a first position;

wherein said release lever includes a slot and in a normal operating condition said inertia lever is aligned with said slot to allow actuation of said release lever, said release lever slot presenting sides for engaging a portion of said inertia lever for automatically toggling said inertia lever away from said first position in response to movement of said release lever to prevent seizing of said inertia lever within the latch mechanism;

and wherein said inertia lever includes a counterweight portion for moving said inertia lever out of alignment with said slot and into blocking engagement with said release lever in response to a side impact upon the vehicle in order to prevent actuation of said release lever and thereby inhibit movement of said latch hook from said locked position into said unlocked position.

2. A latch mechanism according to claim 1, wherein said inertia lever includes a tab and said slot of said release lever is aligned with and engages said tab when said release lever is actuated to unlock said latch hook when said inertia lever is in said first position.

3. A latch mechanism according to claim 2, wherein upon side impact said inertia lever moves to said blocking engagement position such that said tab is not aligned with said slot.

4. A latch mechanism according to claim 3, wherein said inertia lever is pivotally mounted within said latch mechanism.

5. A latch mechanism for selectively latching a door to an automotive vehicle, said latch mechanism comprising:

a housing including a first side and an opposite second side;

a latch hook disposed on said first side of said housing and moveable between a locked position and an unlocked position;

a release lever disposed on said second side of said housing and operatively coupled to said latch hook for selectively moving said latch hook from said locked to said unlocked position; and an inertia lever movably supported on said second side of said housing and biased via a spring to a first position;

wherein said release lever includes a slot and in a normal operating condition said inertia lever is aligned with said slot to allow actuation of said release lever, said release lever slot presenting sides for engaging a portion of said inertia lever for automatically toggling said inertia lever away from said first position in response to movement of said release lever to prevent seizing of said inertia lever within the latch mechanism;

and wherein said inertia lever includes a counterweight portion for moving said inertia lever into a second position out of alignment with said slot in response to a side impact upon the vehicle in order to prevent actuation of said release lever and thereby inhibit movement of said latch hook from said locked position into said unlocked position.

6. A latch mechanism for selectively latching a door to an automotive vehicle, said latch mechanism comprising:

a latch hook moveable between a locked position and an unlocked position;

a release lever operatively coupled to said latch hook for selectively moving said latch hook from said locked to said unlocked position;

an inertia lever including a counterweight portion movably supported within said latch mechanism for blocking movement of said release lever in response to a side impact upon the vehicle;

means for biasing said inertia lever to a first position;

wherein said release lever includes a slot presenting sides for engaging a portion of said inertia lever for automatically toggling said inertia lever in response to movement of said release lever to prevent seizing of said inertia lever within the latch mechanism;

wherein said inertia lever includes a tab and said slot of said release lever is aligned with and engages said tab when said release lever is actuated to unlock said latch hook when said inertia lever is in said first position;

wherein upon said side impact said inertia lever moves to a second position such that said tab is not aligned with said slot to thereby block movement of said release lever.

7. A latch mechanism according to claim 6, wherein said inertia lever is pivotally mounted within the latch mechanism and said release lever is pivotally mounted within the latch mechanism.

8. A latch mechanism according to claim 4, wherein said release lever is pivotally mounted within the latch mechanism.

* * * * *